US006827303B2

(12) United States Patent
Yanase

(10) Patent No.: US 6,827,303 B2
(45) Date of Patent: Dec. 7, 2004

(54) FINE POWDERED SAND GATHERING SYSTEM IN DRY CONDITION

(76) Inventor: Sigeo Yanase, 27-19, Gion 3-chome, Kisarazu City, Chiba (JP)

( * ) Notice: Subject to any disclaimer, the term of this patent is extended or adjusted under 35 U.S.C. 154(b) by 83 days.

(21) Appl. No.: 10/207,398

(22) Filed: Jul. 29, 2002

(65) Prior Publication Data

US 2003/0226920 A1 Dec. 11, 2003

(30) Foreign Application Priority Data

Jun. 6, 2002 (JP) ..... 2002-165478

(51) Int. Cl.[7] ..... B02C 23/26
(52) U.S. Cl. ..... 241/57; 241/72
(58) Field of Search ..... 241/57, 71, 72, 241/70, 60, 79.2, 180

(56) References Cited

U.S. PATENT DOCUMENTS 3,712,549 A * 1/1973 Cleemann ..... 241/19
3,877,650 A * 4/1975 Cornford ..... 241/71
4,050,635 A * 9/1977 Mueller et al. ..... 241/24.1
4,083,500 A * 4/1978 Kartman ..... 241/54
4,369,926 A * 1/1983 Rasmussen et al. ..... 241/18
5,174,512 A * 12/1992 Orlandi ..... 241/72

FOREIGN PATENT DOCUMENTS

JP 06-091191 4/1994
JP U3071823 7/2000

* cited by examiner

*Primary Examiner*—Mark Rosenbaum
(74) *Attorney, Agent, or Firm*—Henneman & Saunders; Larry E. Henneman, Jr.

(57) ABSTRACT

A dry type fine powder collecting system enables a crusher and triturator which process materials under dried condition, to efficiently collect the fine powder generated during processing. In addition, the same washing effect as is obtained in wet conditions is acquired without needing a large amount of equipment cost, the quality and processing efficiency of the product is improved, and the work environment is also improved. The fine powder collection system includes a plurality of air supply lines and a plurality of auction lines, one of each of which is provided to each of a plurality of processing spaces within the crusher or triturator. The air supply floats the fine powder generated during crushing or triturating by blowing vapor into each processing space, and a suction supply sucks the fine powder floated by the air supply from each processing space.

25 Claims, 9 Drawing Sheets

FINE POWDERED SAND GATHERING SYSTEM IN DRY CONDITION

FOREIGN PRIORITY

This application claims the right of foreign priority to Application No. Tokugan2002-165478 filed in Japan on Jun. 6, 2002, which is incorporated herein by reference in its entirety.

TECHNICAL FIELD OF THE INVENTION

The present invention relates to a fine powdered sand gathering system in dry condition, which can improve process efficiency and the quality of the fine powder produced during the process in the crusher and triturator.

PRIOR ARTS

A triturator to wear away the surface or raw material and a crusher to crush raw material delicately have been previously used wisely in the various technological fields. For example, triturators have been used abundantly in the production process of aggregate in the fields of architecture and construction.

When the crushing and trituration processes are done with these devices, although these process are done in dry type, and wet type conditions, there are many cases where the dry type process is generally used, because in the wet type, large quantities of water are necessary and treating the water after it is used is difficult.

However, in the case of dry type, large quantities of fine powder occur during the process. Hence, in and after the process, large quantities of fine powder are stirred up in the shop, resulting in a danger of having a bad influence on a worker's body.

Moreover, there has been a problem that the quality of the finished product is decreased by mixing fine powder in the product. Another problem is that the processing efficiency of the crush and trituration operations is decreased due to the fine powder attaching to the device.

The present invention is invented in consideration of these problems, and its purpose is to provide a fine powdered sand gathering system for use in dry condition that can efficiently and securely collect the fine powder which occurs during the crushing and trituration processes, reduces equipment cost, can get the same effect on washing as the wet processing effect, can improve the quality of the product and the processing efficiency and can improve the working environment near the crusher and triturator which deals with raw material of the dry type.

DETAILED DESCRIPTION OF THE INVENTION

Hereinafter, preferred embodiments of the fine powdered sand gathering system in dry condition of the present invention are explained with reference to the drawings.

The system which relates to the present invention has a processing space to house, crush and triturate raw materials, and it is adapted to a device which crushes or triturates the raw material by dry type processing in the processing space.

In a particular embodiment, a crusher such as a Super Thunder (product name: manufactured by Kawasaki Heavy Industries, Ltd.) and a triturator such as a ball mill or a rod mill are exemplified, but the invention is not limited to these devices.

Hereinafter, the embodiment of the present invention described is mentioned as an example only. As described above, the device with which the present invention is applied is not limited to this, but also can be applied to well known commercial crushers and a triturators.

Figure 1:
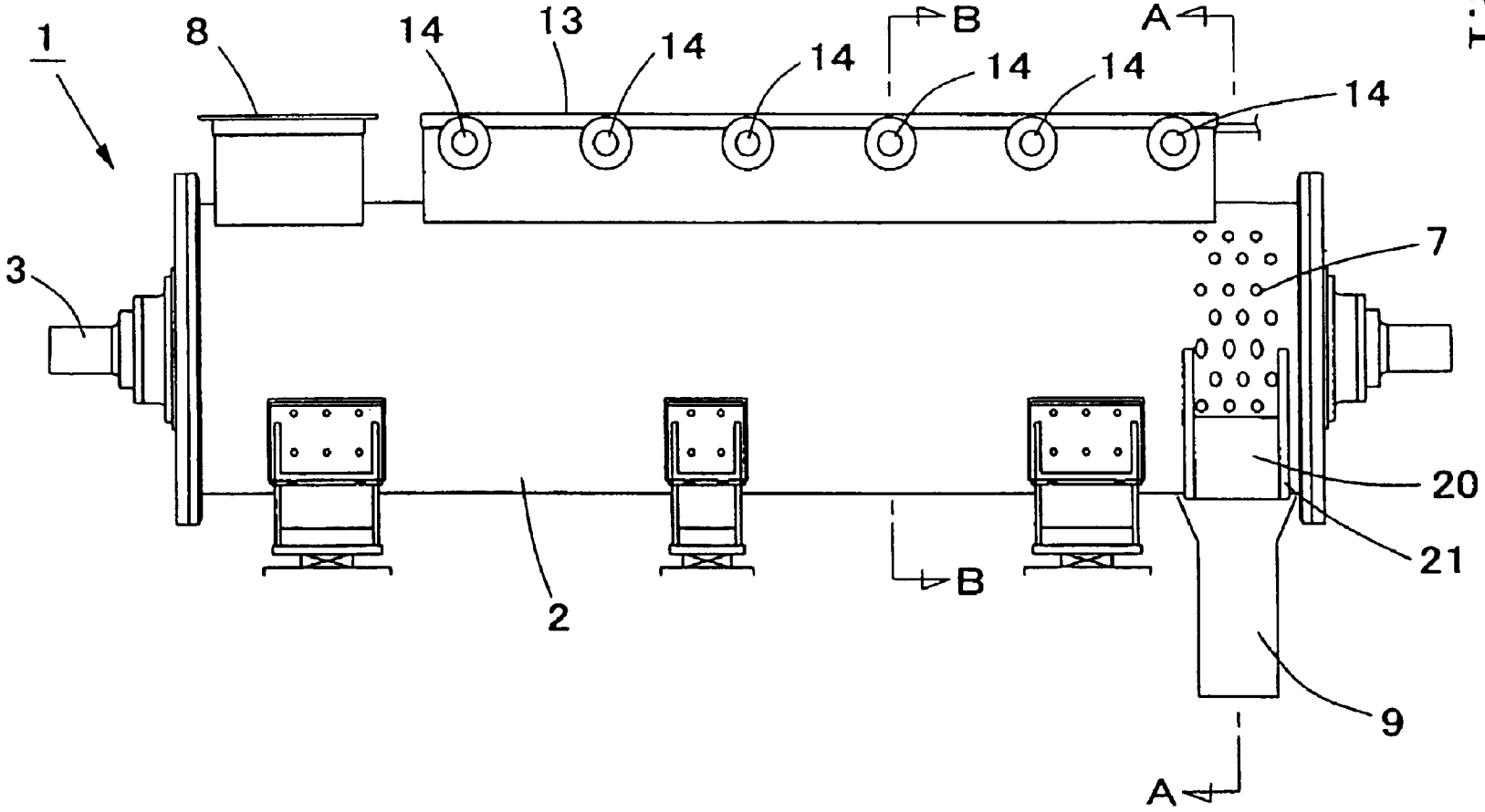
FIG. 1 is a front view of a triturator applying the system according to the present invention.
Figure 2:
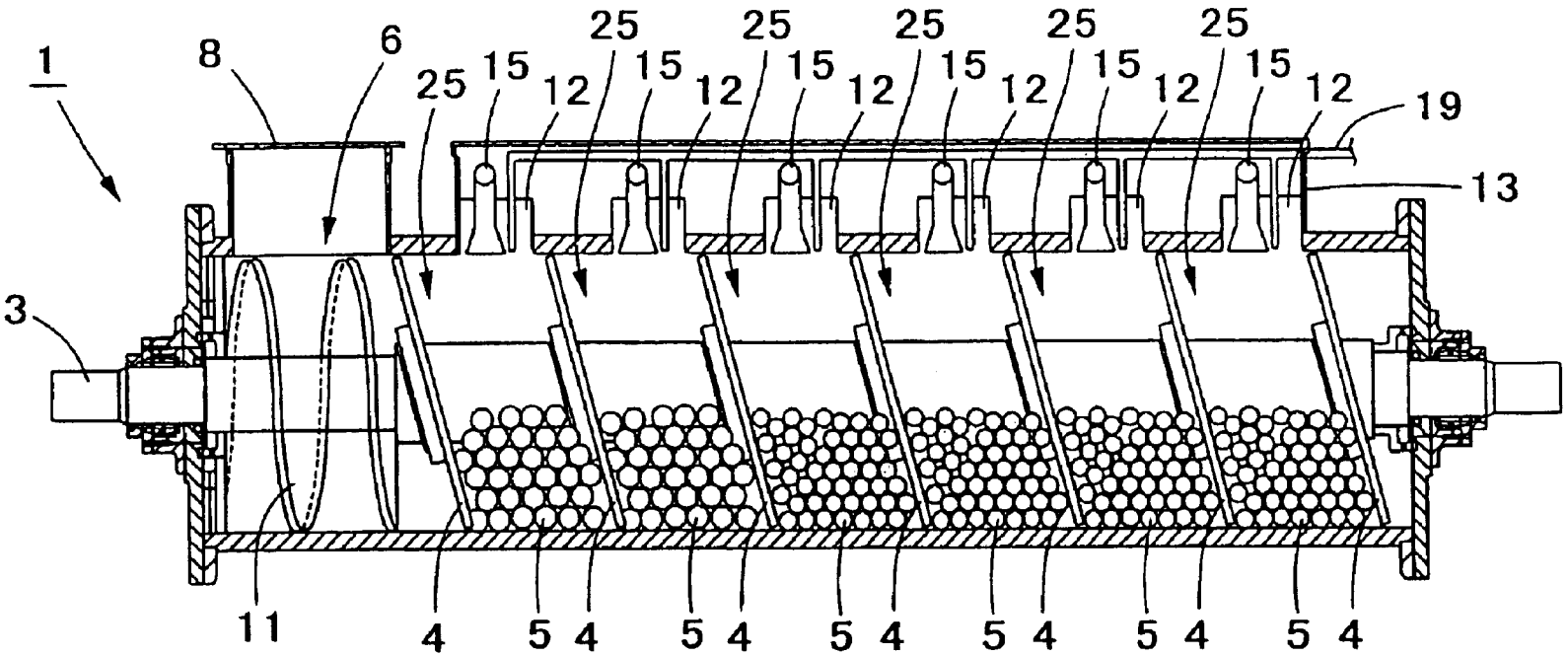
FIG. 2 is a longitudinal sectional view of the triturator applying the system according to the present invention.
Figure 3:
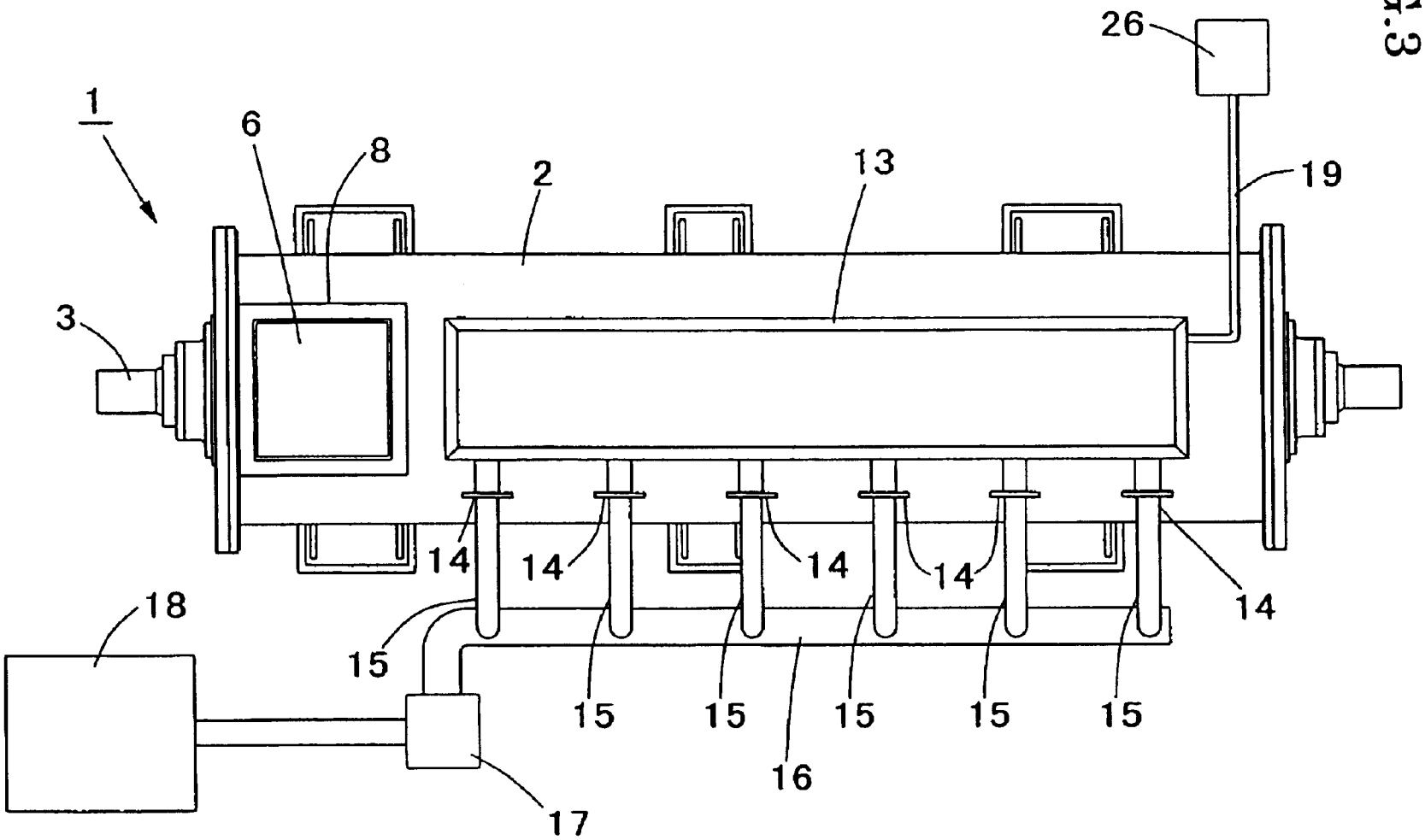
FIG. 3 is a plan view of the triturator applying the system according to the present invention.
Figure 4:
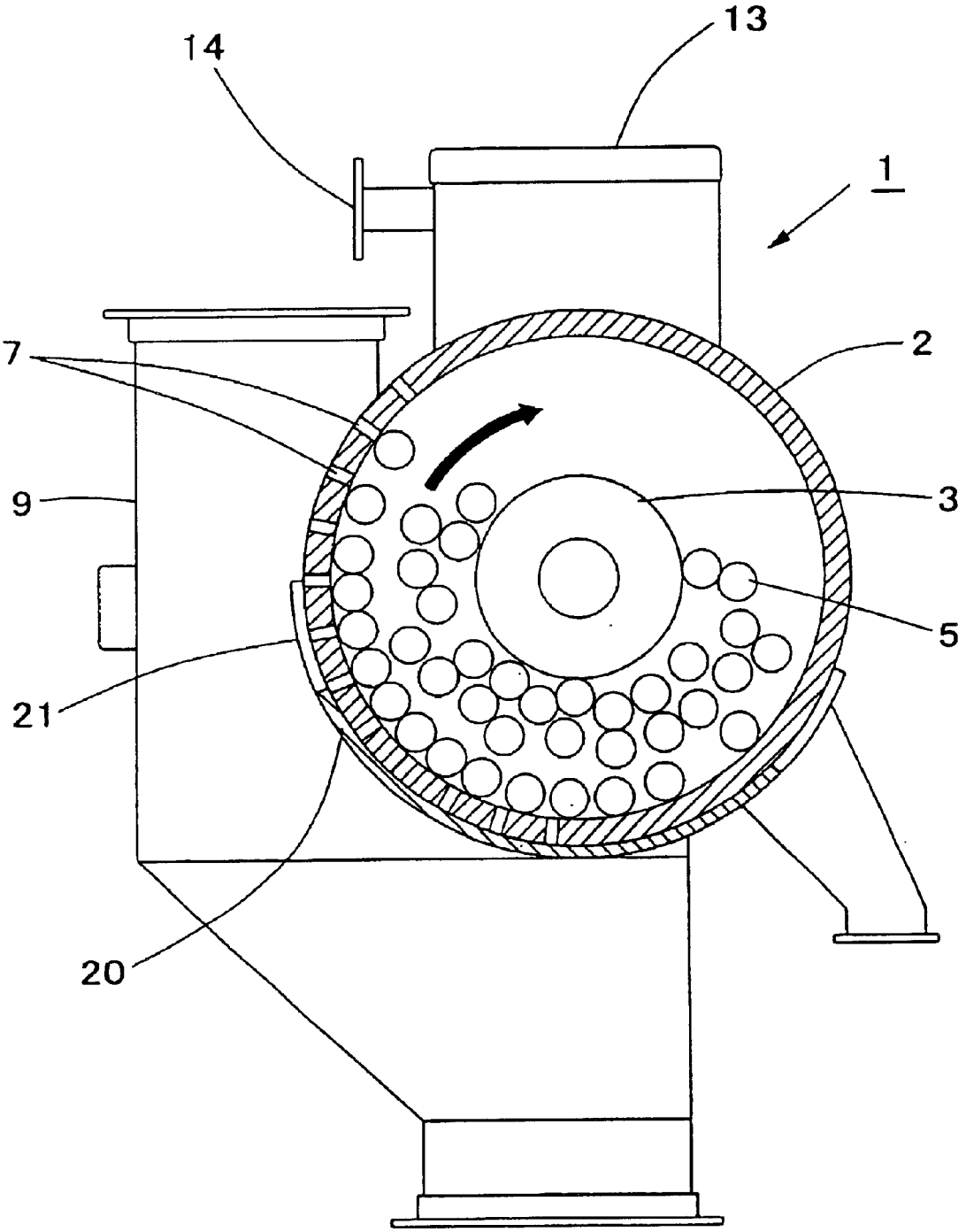
FIG. 4 is a sectional view taken along line A—A of FIG. 1.
Figure 5:
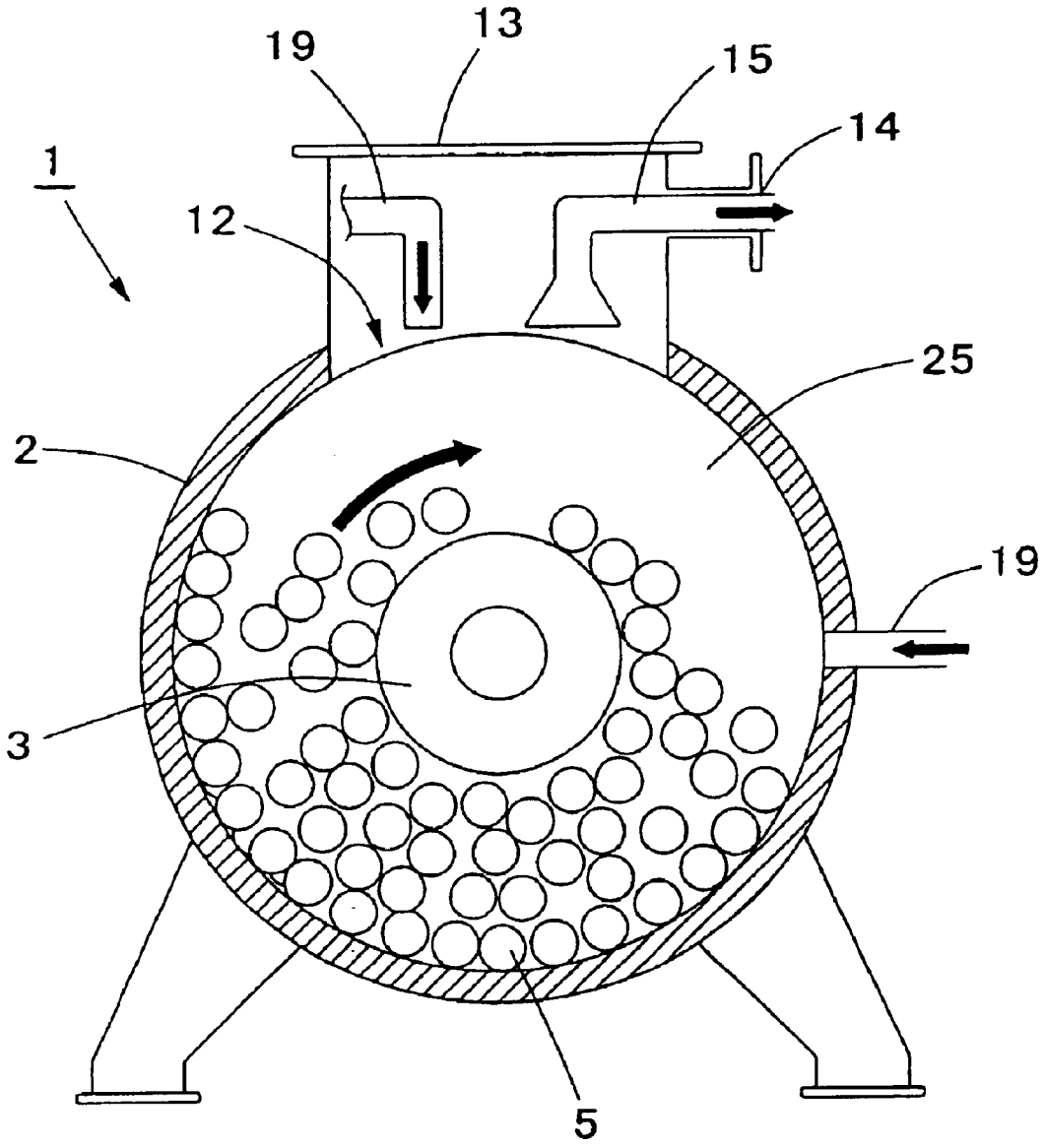
FIG. 5 is a sectional view taken along line B—B of FIG. 1.

FIG. 1 is a front view of a triturator which relates to the present invention, FIG. 2 is a longitudinal sectional view, of the FIG. 1, FIG. 3 is a plan view of the triturator of FIG. 1, FIG. 4 is a cross-sectional view of the triturator of FIG. 1 taken along line A—A and FIG. 5 is a cross-sectional view of the triturator of FIG. 1 taken along line B—B.

A tritulator (1) has a drum body (2), a rotation shaft (3), a partition member (4) and a loading for trituration (5). An inlet port (6) which brings in triturated material (raw material) is set up in one end part of the cylinder-shaped drum body (2), and an outlet port (7) which discharges triturated material after trituration is set up in other end part.

The inlet port (6) is large and open through the surface of the drum body (2), and a hopper (8) for injection of the material which is to be triturated is connected at an upper part of the drum body (2) around the inlet port (6).

The outlet ports (7) are constructed from many holes which are formed in one side of the peripheral wall of the drum body (2), and as shown in FIG. 4, a discharging hopper (9) is connected surrounding the holes which compose the outlet ports (7). Also, the discharging hopper (9) is shown completely only in FIG. 4, and a part or all of the discharging hopper (9) is omitted in the other figures.

Moreover, in the other end of the drum body (2) where the outlet ports (7) are formed, a stay adjustment board (20) is located along a portion of about one-third of the peripheral wall of the drum body (2). The stay adjustment board (20) is supported at the right and left end by a support member (21) located a small distance within the lower half of the peripheral wall of the drum body (2), and within limits in which the support component (21) is constructed, the stay adjustment board (20) can slidably move up and down between the support member (21) and the peripheral wall of the drum body (2).

The stay adjustment board (20) is arranged to adjust staying the staying time that the triturated material remains in the drum body (2). When the stay adjustment board (20) moves upward, the outlet ports (7) in almost half of the positions of the drum body are blocked off, and the triturated material is discharged from only the outlet ports (7) that are not covered by the stay adjustment board (20) (see FIG. 4).

Hence, the staying time in the drum body (2) of the triturated material becomes longer.

On the other hand, when the stay adjustment board (20) is moved downward, the blocked outlet ports (7) are opened, and then the triturated material will come to be discharged also from the outlet ports (7) that are in a lower position. Therefore, the staying time within the drum body (2) of triturated material will become shorter.

Figure 6:
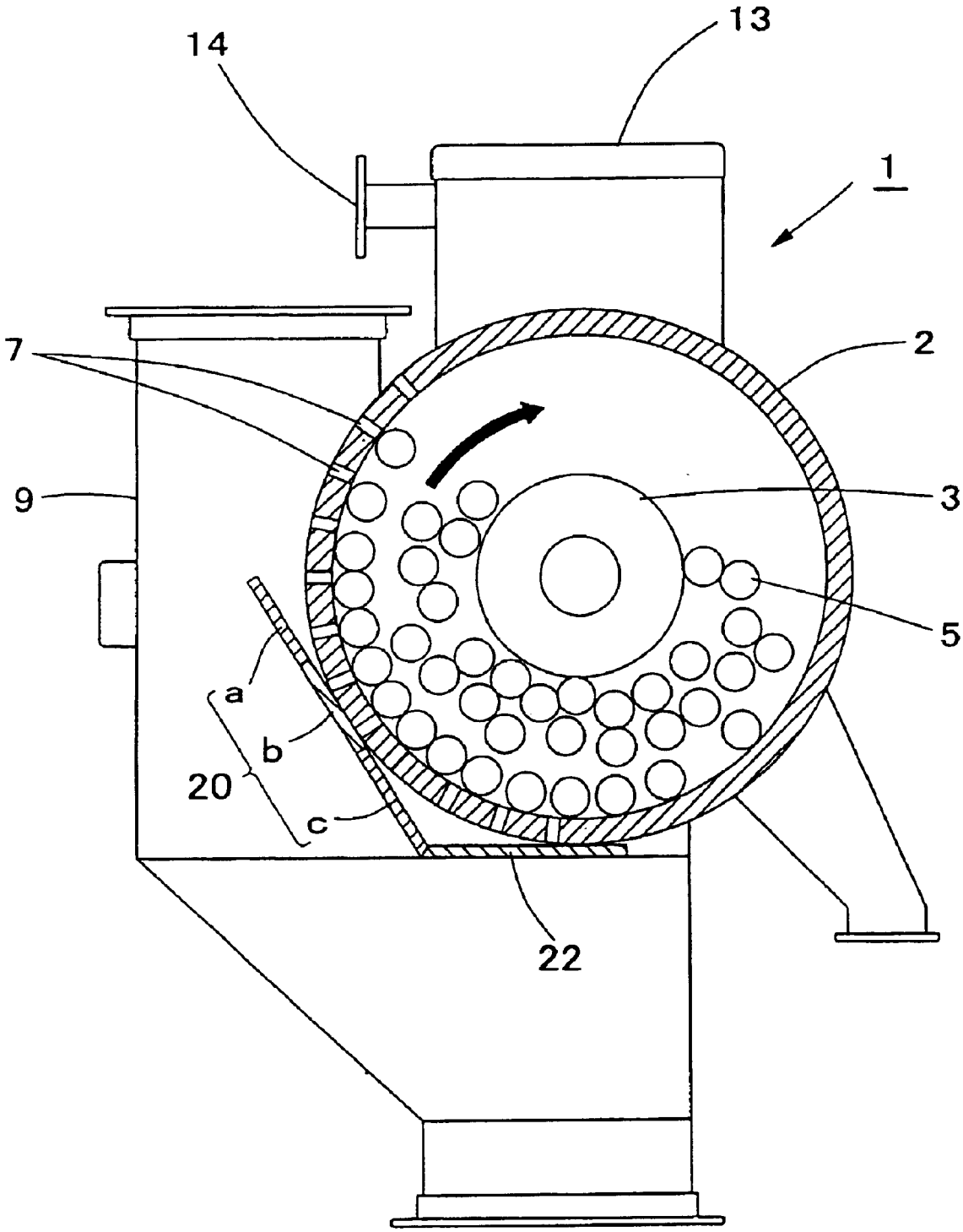
FIG. 6 is a diagram showing another example of a stay adjustment board.

FIG. 6 is an outline figure showing another example of the stay adjustment board (20).

In this example, the stay adjustment board (20) consists of plates (a, b, and c) divided into a plurality of sheets (three sheets are shown in the Figures). The stay adjustment board (20) inclines to a fixed board (22), which is fixed horizontally with respect to the lower portion of the drum body (2). The sheets of the stay adjustment board (20) are connected to and installed with each other.

The stay adjustment board (20) is installed on the same side of the drum body (2) as the outlet port (7), and as shown in the Figures, the height of the stay adjustment board (20) blocks the outlet ports (7) in approximately the lower half of the drum body (2) as shown, when all the boards are connected.

The stay adjustment board (20) as shown in FIG. 6 functions to adjust the staying time of the triturated material within the drum body (2). That is, if all of the plurality of plates which constitute the stay adjustment board (20) are connected, the lower half of the outlet ports (7) will be covered, and only the triturated material near the outlet ports (7) in an upper position of the drum body (2) will be discharged, and the staying time within the drum body (2) of triturated material will become longer.

On the other hand, if one, some or all of plurality of flat plates which make up the stay adjustment board (20) are removed, the blocked outlet ports (7) will be opened, and the triturated material will also be discharged from the outlet ports (7) that are positioned lower in drum body (2). As a result, the stating time within the drum body (2) of the triturated material will become shorter.

The rotation shaft (3) is passes through the end wall of and is axially disposed inside of the drum body (2), and can be rotated by connecting a drive motor (not shown) to an end of thereof.

In addition, the rotation shaft (3) may be solid, or alternatively may be hollow to supply air etc. into processing space (25) via the hollow interior of the shaft.

Each partition member (4) is attached in the rotation shaft (3) at an inclined angle with respect to the rotation shaft (3). The partition members (4) divide the inside of the drum body (2), and form a plurality of processing spaces (25) that communicate mutually in the drum body (2). Although the processing spaces (25) communicate with each other, the size of the communicating parts of the partition members (4) are such that the loadings for trituration (5) cannot pas through the partition members (4).

Each partition member (4) has a plurality of conducting apertures (10), which pass the triturated material between processing spaces 25. The conducting apertures (10) is equivalent to the above-mentioned communicating parts of each processing space (25). The size of the conducting apertures (10) are such that they only pass the triturated material when it becomes under a fixed dimension. In addition, the partition members (4) may include platy portions and/or mesh portions.

Although the number of the partition members (4) is not particularly limited, and one sheet is sufficient, it is desirable to arrange the partition members (4) in the direction of axial length of the rotation shaft (3) such that processing spaces (25) are formed between the partition members (4), to arrange the partition members equidistant from one another, and to use a plurality of sheets as shown in the Figures.

In the case of arranging the partition members (4) in the direction of shaft length of the rotation shaft (3) and the arranging them a distance mutually so as to arrange a plurality of sheets, a size of the conducting apertures (10) arranged in each partition member (4), as described above, are sized to pass only the triturated material under a predetermined size, and it is desirable that the predetermined size is reduced gradually from the partition member (4) of the upstream side of the drum body (2) (end side) to the partition member (4) of the down stream side (other end side).

Figure 7:
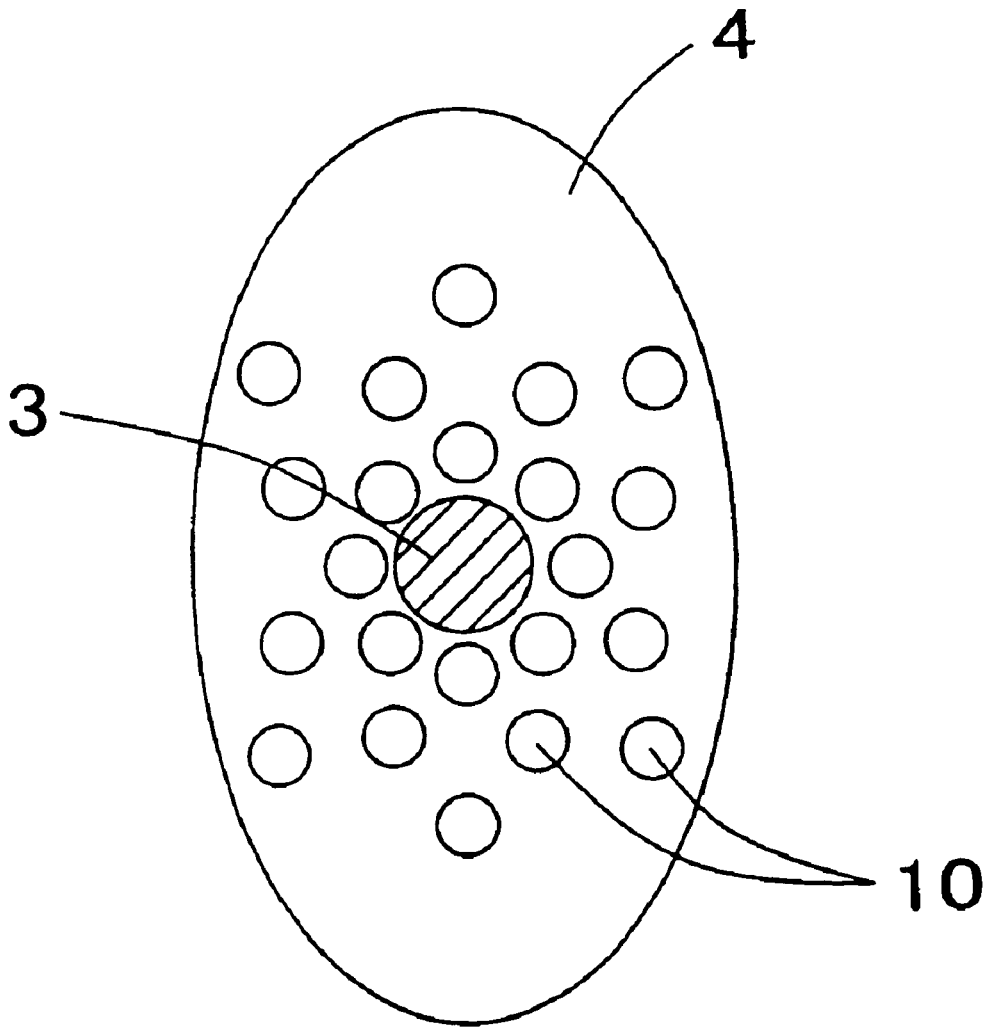
FIG. 7 is a diagram showing one example of the form of a partition member of the triturator of FIG. 2.
Figure 8:
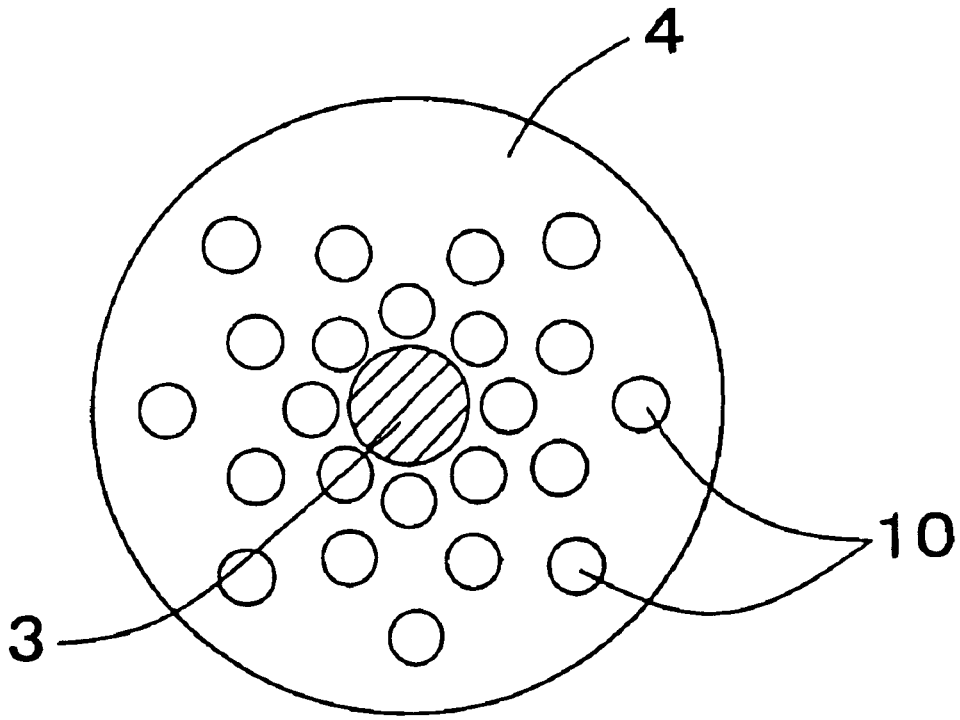
FIG. 8 is a diagram showing one example of the form of a partition member of the present invention.

Although the shape of each the partition member (4) is not particularly limited, one desirable shape is an ellipse so that the circumferential whole edge may stay in close proximity to the inner surface of the drum body (2) as shown in FIG. 7. It is also desirable that partition members (4) be circular in shape as shown in FIG. 8. Moreover, conducting apertures (10) may be formed circularly and/or elliptically or any other shape, such as a quadrangle and a triangle.

A screw (11) is arranged at one end of the rotation shaft (3) below inlet port (6), and it can pass the triturated material which is dropped from the inlet port (6) in the direction of the other end of the drum body (2) due to the rotation of the rotation shaft (3). In addition, the screw (11) is not necessarily required and can also be considered as the composition which prepares the first processing space (25) directly under the inlet port (6), without preparing the screw (11). The loadings for trituration (5) (in following, it is described as the loadings (5)) are deposited inside each processing space (25). The loadings (5) consist of a plurality of metal balls etc., and the triturated material is triturated by colliding with triturated material and loadings (5) in each processing space (25).

An opening (12) is formed in the upper part of each processing space (25) of the drum body (2), respectively, and a box shape part (13) which covers each opening (12) altogether is further formed in the upper part of these openings (12).

The box shape part (13) communicates with the exterior by a plurality of side openings (14) which are opened at the side, and each side opening (14) is arranged in position with respect to a corresponding one of processing spaces (25).

A suction pipe (15) is inserted in each side opening (14), respectively, and a tip of each suction pipe (15) enters from the opening (12), and is arranged in each processing space (25) within the drum body (2). The tip of the suction pipe (15) is broadened in a shape of a circular cone, and can efficiently suck in the fine powder generated in the corresponding processing space (25). Moreover, a base end part of each suction pipe (15) is connected to a single suction path (16), and the suction path (16) is connected to a dust catcher (18) which consists of bag filters through a suction pump (17).

Moreover, box shape part (13) is also arranged over an air supply pipe (19), and the air supply pipe (19) is branched, such that one branch is disposed at each opening (12), and arranged to supply air inside of each processing space (25) of drum body (2).

The base end part of the air supply pipe (19) exits through the side of the box shape part (13) to the outside, and is connected to a ventilator (26).

The tips of the suction pipe (15) and the air supply pipe (19) are inserted into each processing space (25) inside of the drum body (2), and by this, it can independently supply vacuum and air to the inside of each processing space (25).

Further, in the present invention, the air supply pipe (19) can be fixed in not only the top of the drum body (2) but also in the side as shown in the FIG. 5.

Moreover, in the present invention, when a dynamo that supplies electric power for driving the triturator is connected, it is desirable to introduce exhaust heat generated with the dynamo into the processing space (25).

This can be attained by warming the air supplied to the air supply pipe (19) with exhaust heat after the generator is warmed up, and supplying warmth from the air supply pipe (19) to the inside of processing space (25).

Thus, the inside of the processing space (25) can be dried by using exhaust heat and supplying warmth in the processing space (25). Therefore, the fine powder generated in the processing space (25) attaches to the loading (5), attaching of the fine powder to triturated material again is reduced, and processing efficiency is raised.

Figure 9:
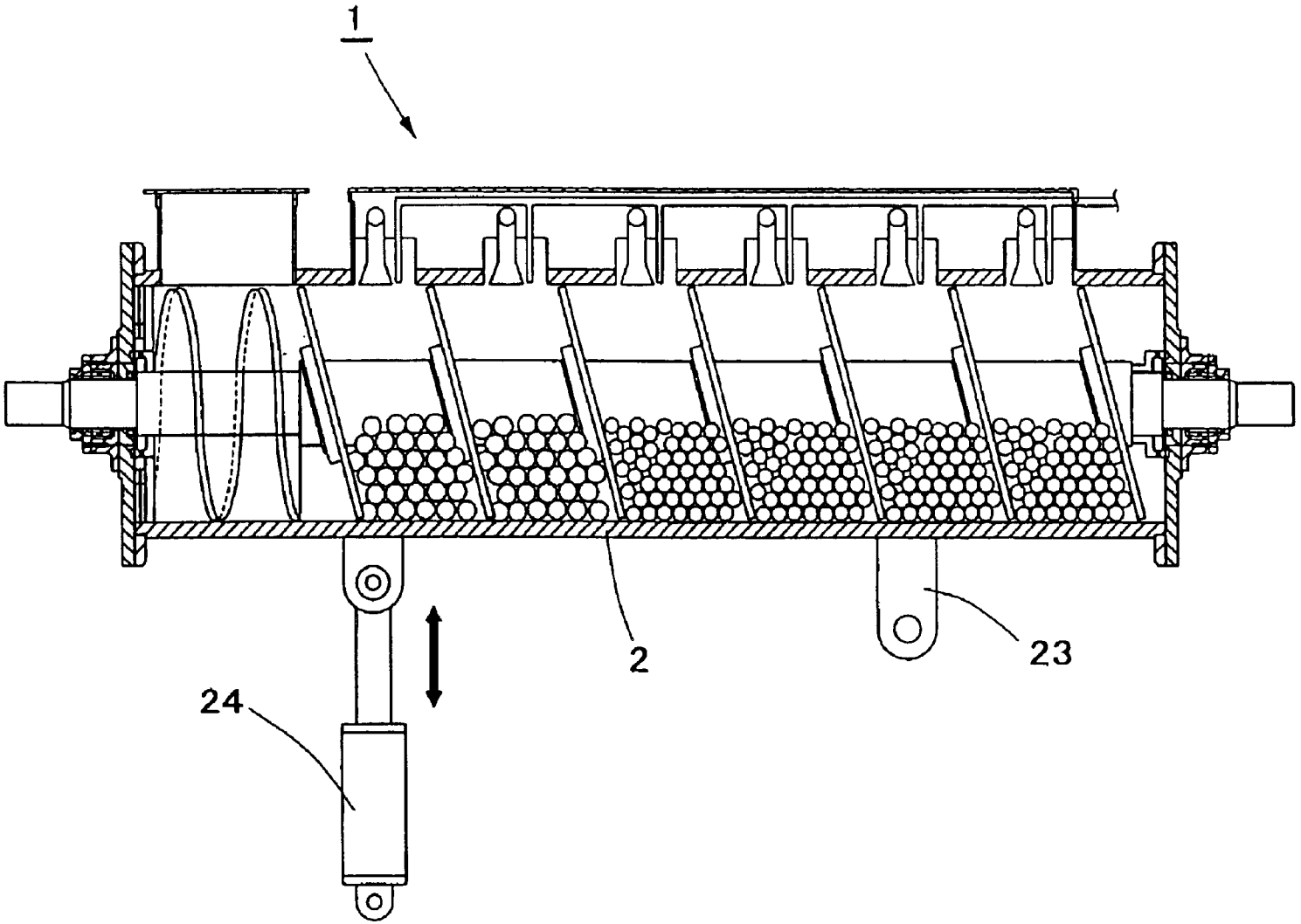
FIG. 9 is a diagram showing the construction of an inclination mechanism.

Moreover, it is desirable to locate an inclination mechanism for making the other end part of the drum body (2) into a low position with respect to the first end part of the drum body (2). FIG. 9 shows the construction of the inclination mechanism. The inclination mechanism is constituted using legs attached under the drum body (2), and consists of a fulcrum leg (23) attached to the other end part (downstream side) of the drum body (2), and a telescopic leg (24) attached to the one end part (upstream side). The fulcrum leg (23) is a portion used as a fulcrum, when the drum body (2) inclines, and includes a circular pin connection. The telescopic leg (24) consists of flexible mechanisms, such as an oil pressure cylinder, and becomes the same length as the fulcrum leg (23) in the state where it is shrunk.

Therefore, if the telescopic leg (24) is shrunk, the drum body (2) will become parallel to the ground, and if the telescopic leg (24) elongates, the drum body (2) becomes inclined downward towards the other end part from the one end part. Moreover, inclination of the drum body (2) can be adjusted by adjusting the degree of extension of the telescopic leg (24).

Alternatively, the telescopic leg (24) is arranged in the other end part (downstream side) of the drum body (2), and the fulcrum leg (23) is arranged in the one end part (upstream side), and the drum body (2) is inclined downward from the one end part to the other end part by making the telescopic leg (24) shorter than the fulcrum leg (23).

By adjusting the inclination mechanism, staying time within the drum body (2) of triturated material can be adjusted, and it becomes possible to easily adjust quality, such as the particle size of the aggregate obtained as the finished product.

Moreover, it is possible to incline upward the drum body (2) from one end part to the other end part by expansion and contraction of the telescopic leg (24), and in this case, it is possible to lengthen the staying time within the drum body (2) of triturated material.

Hereafter, the operation of the system according to the present invention is explained.

First, the material to be triturated is thrown into the drum body (2) from the hopper (8). Then, by rotation of the screw (11) positioned at one end of the rotation shaft (3), the material to be triturated is sent in the direction of the other end (in the example of illustration to the right), and enters the first processing space (25) passing through the conducting apertures (10) arranged in the partition member (4), which is arranged at the first position counted from the upstream side.

Here, since the partition member (4) inclines to the rotation shaft (3), the partition member (4) repeats quickly between its anteversion state and retroversion state with respect to the direction of axial length of the rotation shaft (3), with rotation of the rotation shaft (3). Thereby, while the triturated material and the loading (5) fall after they have been strongly lifted upward by the partition member (4); and the lifting-falling movement is repeated, the first partition member (4) quickly pumps the triturated material in the direction of axial length of the rotation shaft (3). Thereby, the triturated material and the loading (5) collide uniformly, and they are triturate-processed in the first processing space (25).

If the triturate processing has been done in the processing space (25) to a certain degree, the triturated material becomes the size which can pass through the conducting apertures (10) arranged in the second partition member (4) counted from the upstream side, and enter the second processing space (25) through the conducting apertures (10).

And, when the same processing as in the first processing space is performed in the second processing space (25), and when the triturated material is triturated to a certain degree, the triturated material becomes the size which can pass through the conducting apertures (10) arranged in the third partition member (4) counted from upstream side, and thereby enter the third processing space (25).

Thus, the triturated material is gradually approaching the desired particle diameter by passing through in order two or more processing spaces (25) arranged in the drum body (2). The triturated material which has obtained the desired particle diameter is discharged through the outlet ports (7) prepared in the right end part of the drum body (2) to the discharging hopper (9).

The triturated material which was discharged can be used, for example, as an aggregate for concretes (RC-20).

Thus, when the triturated material which was thrown in the drum body (2) undergoes triturate processing in each processing space (25), a lot of fine powder is generated in each processing space (25).

Then, in the present invention, during the triturate processing described as above, air is blown off downward from the air supply pipe (19) in each processing space (25), and the fine powder deposited in each processing space (25) is floated in the air by this, and sucking power is simultaneously generated at the tip of each suction pipe (15), and the fine powder which was floated in each processing space (25) is sucked and collected.

Thereby, in spite of being in dried condition, the same washing effect of the triturated material as in wet condition is acquired, and as shown in the example described hereinafter, this enables the quality of the final product, such as aggregate, to be greatly improved.

The fine powder which was sucked by the suction pipe (15) is of particle diameter, for example, 0 to 1 mm, and 0 to 2 mm, and the fine powder sucked into the suction pipe (15) in each processing space (25) is passed to a bag filter (18) by way of suction passage (16) and then collected there.

Thus, the fine powder collected in this way can be reused, for example as a soil improvement material.

EXAMPLES

Hereafter, the effect of the present invention is defined by showing examples and comparative examples of the system according to the present invention. However, the present invention is not limited at all by the following examples.

Example

Employing concrete husks as raw material, triturate processing was performed using a triturator as shown in FIG. 1 to FIG. 5, and an aggregate for concretes (RC-20) was obtained as a finished product.

Comparative Example

In the triturator used in the example, the suction pipe (15) and the air supply pipe (19) were removed, and the same triturate processing as the example was performed, and an aggregate for concretes (RC-20) was obtained as a finished product.

The processing efficiency of the triturator used in the example and comparative example, and also the acquired characteristics of the aggregate for concretes are shown in Table 1.

TABLE 1

| Items | Quality Standard | Example | Comparative Example |
|---|---|---|---|
| Processing Efficiency (ton/hr) | — | 30 | 20 |
| Density (in absolute dry condition) (g/cm$^3$) | more than 2.5 | 2.62 | 2.52 |
| Percentage of Water Absorption (%) | less than 3.0 | 1.55 | 2.35 |
| Percentage of Accomplishment (%) | more than 55 | 60.1 | 56.5 |
| Quantity lost by washing test (%) | less than 1.0 | 0.3 | 3.5 |

As shown in Table 1, compared with the comparative example, processing efficiency of the example which applied the fine powdered sand gathering system in dry condition according to the present invention was improved by about 1.5 times. Moreover, the aggregate obtained in the example was superior to the aggregate obtained by the comparative example in all JIS quality-standards items of density (in absolute dry condition), percentage of water absorption, percentage of accomplishment, and quantity lost by washing test. Especially, in the comparative example, the quantity lost by the washing test was not able to fulfill the quality standards, but the lost quantity by the washing test in the example using the gathering system of the present invention is one tenth of that of the comparative example, and was fully able to meet the quality standards.

From this result, when the system according to the present invention is applied, it is possible that by directly suctioning and collecting the fine powder generated during processing from processing space, the processing effect is drastically improved by preventing attachment of the generated fine powder on the balls (i.e., the loading) and the triturated material. In addition, the same washing effect of triturated material as in wet condition is acquired by the suction, and the quality of the finished product is improved by preventing attachment and mixing of the generated fine powder to/with the product.

Effects of the Invention

As described above, according to one aspect of the present invention, in the crusher and triturator which process materials in dried condition, a certain and efficient collection of the fine powder generated by the crushing or triturating processes can be performed, and without needing a large amount of equipment cost. As a result, the work environment can be improved by preventing generation of coarse particulates, and in spite of being in dried condition, the same washing effect of triturated material as in wet condition is acquired. Therefore the quality of products and processing efficiency can be improved.

Moreover, according to another aspect of the present invention, most of the fine powder which was sucked by the suction means is certainly collected, and it can be reused, for example as a soil improvement material.

Moreover, according to another aspect of the present invention, it becomes possible to efficiently collect the fine powder generated in the crusher and triturator which has two or more processing spaces.

According to another aspect of the present invention, a triturator which has very high triturating efficiency can be obtained.

According to another aspect of the present invention, by effective utilization of exhaust heat, trituration processing efficiency can be improved.

According to another aspect of the present invention, while floating the fine powder in the processing space, it can be dried simultaneously, and this is very efficient.

According to another of the present invention, it becomes possible to adjust the stay time of the triturated material in the drum body, and to adjust the quality of the finished product easily.

What is claimed is:

1. A triturator to crush or triturate raw material under dried condition, said triturator comprising:

a drum body including an inlet port to bring in raw material arranged in one end part, and a plurality of outlet ports to discharge processed material after processing arranged in another end part;

a rotation shaft which pierces the inside of the drum body in the direction of axial length of the drum body;

at least one partition member attached to the shaft at an inclined angle to divide the inside of the drum body and form a plurality of processing spaces which communicates mutually in the drum body;

plural loadings in said processing spaces that move up and down repeatedly with rotation of the rotation shaft for processing said raw materials;

a blower having a plurality of outlets for blowing air into each said processing space to float fine powder caused by said processing; and an aspirator having a plurality of inlets to suck in fine powder floated from each said processing space by said blower.

2. A triturator to crush or triturate raw material under dried condition according to claim 1, wherein: said aspirator is connected to a bag filter.

3. A triturator to crush or triturate raw material under dried condition according to claim 1, wherein: exhaust heat of a dynamo which supplies electric power for driving to said triturator is introduced in said processing space.

4. A triturator to crush or triturate raw material under dried condition according to claim 2, wherein exhaust heat of a dynamo which supplies electric power for driving to said triturator is introduced in said processing space.

5. A triturator to crush or triturate raw material under dried condition according to claim 3, wherein said exhaust heat is introduced into the processing spaces by said blower.

6. A triturator to crush or triturate raw material under dried condition according to claim 4, wherein said exhaust heat is introduced into the processing spaces by said blower.

7. A triturator to crush or triturate raw material under dried condition according to claim 1, wherein said triturator further comprises a stay adjustment board disposed to block a part of said plurality of outlet ports.

8. A triturator to crush or triturate raw material under dried condition according to claim 2, wherein said triturator further comprises a stay adjustment board disposed to block a part of said plurality of outlet ports.

9. A triturator to crush or triturate raw material under dried condition described in claim 3, wherein said triturator further comprises a stay adjustment board disposed to block a part of said plurality of outlet ports.

10. A triturator to crush or triturate raw material under dried condition according to claim 4, wherein said triturator further comprises a stay adjustment board disposed to block a part of said plurality of outlet ports.

11. A triturator to crush or triturate raw material under dried condition according to claim 1, further comprising an inclination mechanism under said drum body so that said another end part of the drum body is arranged lower in position than said one end part.

12. A triturator to crush or triturate raw material under dried condition according to claim 2, further comprising an inclination mechanism under said drum body so that said another end part of the drum body is arranged lower in position than said one end part.

13. A triturator to crush or triturate raw material under dried condition according to claim 3, further comprising an inclination mechanism under said drum body so that said another end part of the drum body is arranged lower in position than said one end part.

14. A triturator to crush or triturate raw material under dried condition according to claim 4, further comprising an inclination mechanism under said drum body so that said another end part of the drum body is arranged lower in position than said one end part.

15. A triturator to crush or triturate raw material under dried condition according to claim 5, wherein said triturator further comprises a stay adjustment board disposed to block a part of said plurality of outlet ports.

16. A triturator to crush or triturate raw material under dried condition according to claim 6, wherein said triturator further comprises a stay adjustment board disposed to block a part of said plurality of outlet ports.

17. A triturator to crush or triturate raw material under dried condition according to claim 5, further comprising an inclination mechanism under said drum body so that said another end part of the drum body is arranged lower in position than said one end part.

18. A triturator to crush or triturate raw material under dried condition according to claim 6, further comprising an inclination mechanism under said drum body so that said another end part of the drum body is arranged lower in position than said one end part.

19. A triturator to crush or triturate raw material under dried condition according to claim 7, further comprising an inclination mechanism under said drum body so that said another end part of the drum body is arranged lower in position than said one end part.

20. A triturator to crush or triturate raw material under dried condition according to claim 8, further comprising an inclination mechanism under said drum body so that said another end part of the drum body is arranged lower in position than said one end part.

21. A triturator to crush or triturate raw material under dried condition according to claim 9, further comprising an inclination mechanism under said drum body so that said another end part of the drum body is arranged lower in position than said one end part.

22. A triturator to crush or triturate raw material under dried condition according to claim 10, further comprising an inclination mechanism under said drum body so that said another end part of the drum body is arranged lower in position than said one end part.

23. A triturator to crush or triturate raw material under dried condition according to claim 15, further comprising an inclination mechanism under said drum body so that said another end part of the drum body is arranged lower in position than said one end part.

24. A triturator to crush or triturate raw material under dried condition according to claim 16, further comprising an inclination mechanism under said drum body so that said another end part of the drum body is arranged lower in position than said one end part.

25. A triturator to crush or triturate raw materials under dried condition according to claim 1, wherein:

said outlets of said blower are disposed to blow air through a side wall of said drum body; and said inlets of said aspirator are disposed to suck air through said side wall of said drum body.

* * * * *